United States Patent [19]

Solomon

[11] 4,345,635

[45] Aug. 24, 1982

[54] ROLLING PROTECTIVE GATE FOR STORE FRONTS OR THE LIKE

[76] Inventor: Martin D. Solomon, 26 Margaret Ave., Lawrence, N.Y. 11559

[21] Appl. No.: 182,577

[22] Filed: Aug. 29, 1980

[51] Int. Cl.[3] ..... E06B 9/08

[52] U.S. Cl. ..... 160/133; 160/235; 160/236

[58] Field of Search ..... 160/133, 206, 229 R, 160/231 A, 235, 236

[56] References Cited

U.S. PATENT DOCUMENTS

| | | | |
|---|---|---|---|
| 2,388,297 | 11/1945 | Slaughter | 160/235 |
| 2,699,827 | 1/1955 | Carson | 160/229 R |
| 2,831,537 | 4/1958 | Ritter | 160/229 R |
| 3,101,485 | 8/1963 | Kirshenbaum | 160/235 |
| 3,894,571 | 7/1975 | Hinchliff | 160/235 |
| 4,037,639 | 7/1977 | Jones | 160/235 |
| 4,120,340 | 10/1978 | Stascavage et al. | 160/133 |
| 4,126,173 | 11/1978 | Theuerkauff | 160/229 R |

FOREIGN PATENT DOCUMENTS

| | | | |
|---|---|---|---|
| 1046295 | 12/1958 | Fed. Rep. of Germany | 160/235 |
| 1530680 | 5/1968 | France | 160/235 |

*Primary Examiner*—Peter M. Caun

*Attorney, Agent, or Firm*—Edward F. Levy

[57] ABSTRACT

A rolling protective gate for store fronts or the like is formed of a series of horizontally-extending transparent slats interconnected and articulated by a series of horizontally-extending metal rods. The transparent slats and metal rods are elongated, and each extends the full width of the building front access opening in which the rolling gate is mounted. The transparent slats and metal rods are privotally interconnected by means of circular ribs extending along the top and bottom edges of each slat which are received within sockets formed in the metal rods. The entire rolling gate is formed of the connected slats and rods for easy assembly, and the elongated horizontal transparent slats provide ready visibility through the rolling gate when the latter is in its lowered position providing a security closure for the store front.

10 Claims, 9 Drawing Figures

ROLLING PROTECTIVE GATE FOR STORE FRONTS OR THE LIKE

BACKGROUND OF THE INVENTION

The present invention relates to improvements in rolling gates or doors which serve as security closures for store fronts, building entrances and the like.

Rolling gates or doors are normally made in open grille form, and consist of an articulated metal grid structure composed of spaced horizontal and vertical metal rods interconnected by links to enable the grille to be rolled up to an open position and rolled down to a closed position. When employed as a security gate for a store front, the grille covers over both the door and store front window in order to prevent unauthorized access to the store through the door or window. Conventionally, such gates comprise an open metal grid or grille structure which enables the public to view the window displays of the store through the grille even though the store is closed and the security gate is locked in lowered position.

Examples of conventional open-work articulated rolling grilles of the aforementioned type are shown, for example in U.S. Pat. Nos. 2,898,988, 3,601,175 and 3,850,465. Because of their reticulated construction, such grilles have the advantage of providing a clear view of the store front covered by the grille, as well as the ready passage of light through the grille. However, they have the disadvantage of impaired security. Prowlers are able to insert a bar or other object through the open spaces between the bars and links in order to break through the store window and can then insert a long hook or other tool through the grille opening and the broken window for the purpose of removing merchandise from the window display.

Attempts have been made to solve this problem by providing rolling gates with articulated horizontal slats or panels made of metal and each having a row of spaced rectangular apertures constituting windows through which persons in the street can see the store front covered by the gate. In some instances, these window apertures are filled with panes of glass or transparent plastic which add a security feature in preventing persons outside the closed gate from reaching through the rectangular apertures. Rolling gates of this type are shown in U.S. Pat. Nos. 1,352,656 issued Sept. 14, 1920 and 2,592,888 issued Apr. 15, 1952. Gates with such panel window apertures do not, however, provide adequate visibility, and further are expensive in manufacture.

In U.S. Pat. No. 4,120,340, there is disclosed a rolling grille composed of a series of horizontal metal rods interconnected at several intermediate points by a plurality of metal links to form the grillework structure. A transparent panel is disposed between each pair of adjacent rods and is connected at its ends between each pair of adjacent links so that the grille is formed of a large number of small transparent panels aligned in columns and rows. While the transparent panels of this rolling grille prevent penetration of the grille for security purposes, and at the same time provide acceptable visibility through the grille, the inherent structural requirements of the grille result in high manufacturing costs. To enable the grille to be rolled up in stored condition, the horizontal rods are in practice spaced approximately three to nine inches apart, and to provide a grille of suitable strength, the vertical chains of links are spaced apart by distances between one and one-half inches to twelve inches. Consequently, for a conventional grille of fifteen foot height, hundreds of transparent panels are required, each panel being individually connected between a pair of adjacent links. Assembly of these grilles within a store front is also difficult and time-consuming.

SUMMARY OF THE INVENTION

It is an object of the present invention to provide a rolling gate of the type described in which vertical rods or links are completely eliminated and in which the gate is not made in open grille form but nevertheless provides a high degree of visibility therethrough when the gate is in lowered position providing an effective security closure for a store front or the like.

Another object of the invention is the provision of a rolling gate of the type described in which the entire body of the gate is formed of only two different components, namely a plurality of elongated transparent slats which extend horizontally the entire width of the store front, and a plurality of elongated metal rods which pivotally interconnect the transparent slats and also extend the full width of the store front. The gate is therefore economical in manufacture, as compared with conventional gates or grilles which provide through visibility, and may be assembled and installed easily and rapidly.

Another object of the invention is the provision of a rolling gate of the character described which is virtually tamper-proof because of the elimination of connecting links between the metal rods. The absence of connecting links also provides better and more unobstructed visibility through the lowered gate.

In accordance with the present invention, there is provided a rolling gate adapted to provide a displaceable transparent security closure for a building access opening, said gate comprising a plurality of elongated transparent slats disposed horizontally in vertically-spaced relationship, with each slat being sized to extend across the entire width of the building access opening. The gate also includes a plurality of elongated metal rods interconnecting said slats in their spaced relationship with each of said rods being sized to extend across the entire width of said access opening, and coupling means formed integrally on each of said slats and rods for pivotally connecting each transparent slat along its entire upper and lower edges between a pair of adjacent rods to form the assembled gate.

The coupling means comprises a pair of spaced, opposed sockets in each of said metal rods, and a pair of ribs of circular cross section extending along the upper and lower edges of each of said transparent slats. One rib of each slat is pivotally mounted in a socket of one of said metal rods, and the other rib of said slat is pivotally mounted in a socket of the next adjacent metal rod.

The transparent slats may be made of transparent plastic, and the metal rods may be provided with stop means to limit pivotal movement of said slats relative thereto.

Additional objects and advantages of the invention will be apparent during the course of the following specification when taken in connection with the accompanying drawings, in which.

DETAILED DESCRIPTION

Figure 1:
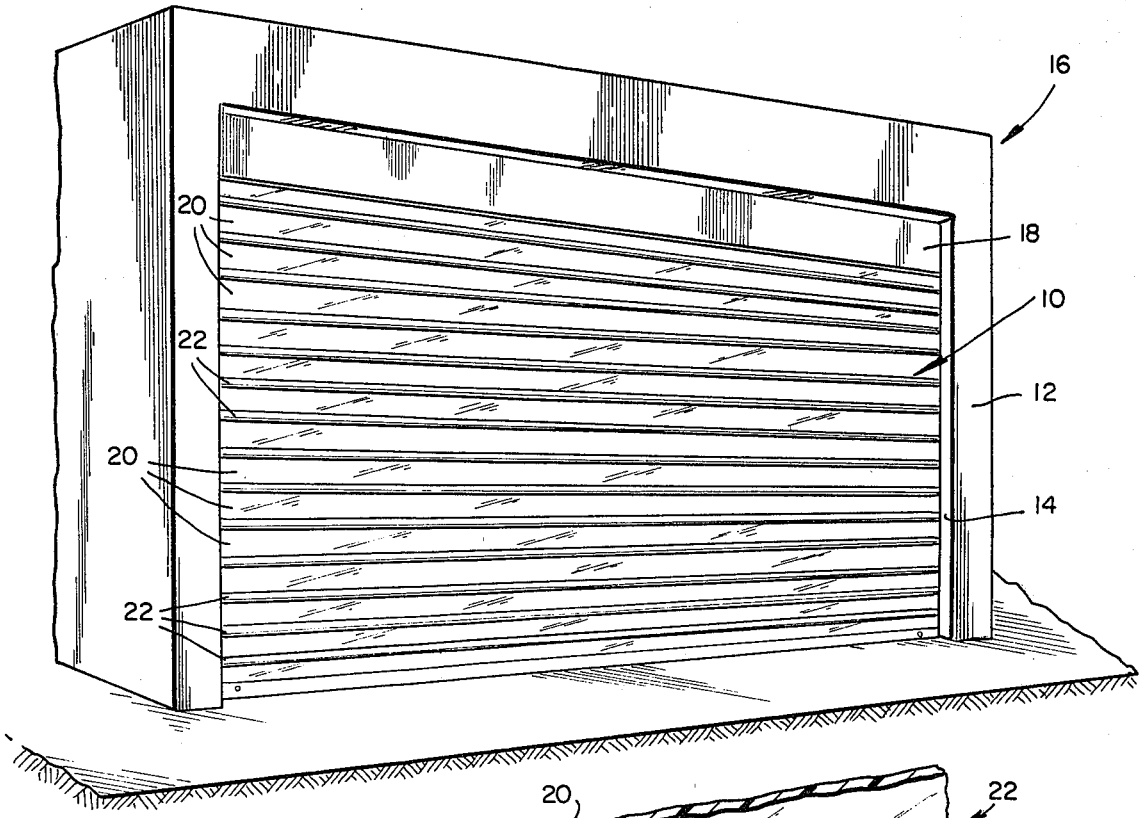
FIG. 1 is a perspective view of a rolling gate made in accordance with the present invention and shown installed as a store front closure, and in lowered, closed position.

Referring in detail to the drawings, there is shown in FIG. 1 a protective rolling gate 10, made in accordance with the present invention, and shown installed in a door frame 12 bordering a front access opening 14 of a building 16. Although the rolling gate 10 may be effectively employed as a security closure for many different types of buidling access openings, it is primarily intended to cover over a store front door. The gate 10 is adapted to be rolled up and down between the lowered, security position as shown in FIG. 1 and an elevated, open position in which it uncovers the access opening 14 and permits passage therethrough. When the gate 10 is raised to its elevated position it is received and enclosed in a conventional hollow heading 18 overlying the access opening 14.

Figure 2:
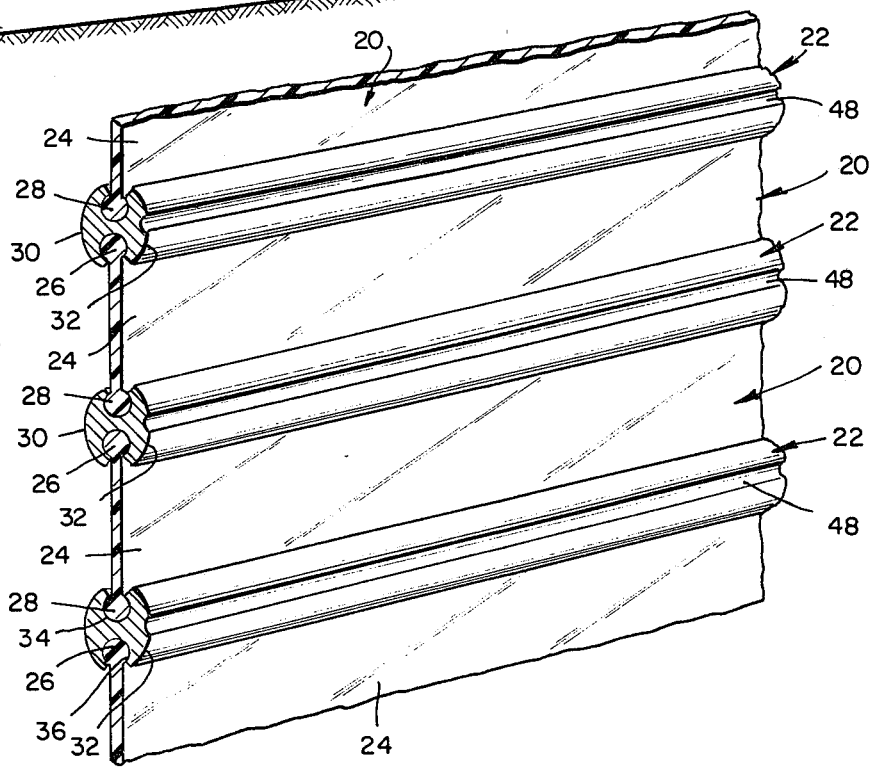
FIG. 2 is an enlarged perspective view of a portion of the rolling gate in FIG. 1, as viewed from the rear thereof and shown partially in section.
Figure 3:
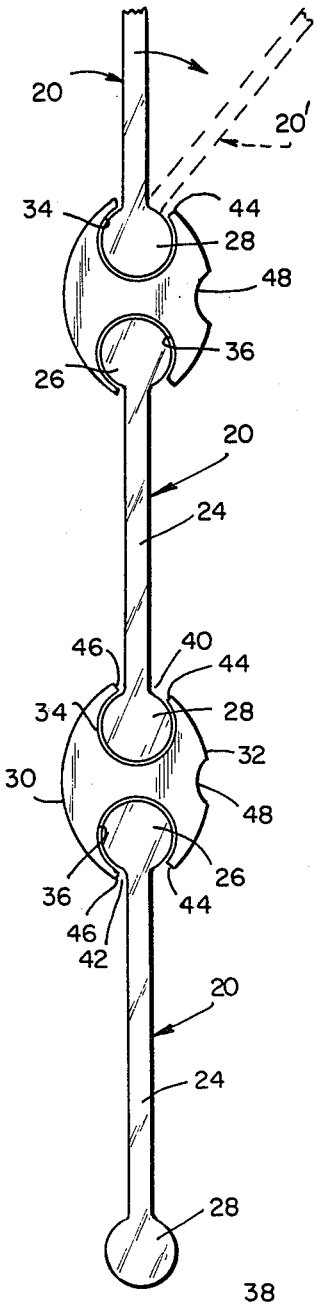
FIG. 3 is an end elevational view of a portion of the rolling gate showing the manner in which the transparent slats thereof are connected to the horizontal metal bars, and indicating in broken line the extent of pivotal movement of the transparent slats relative to the metal bars when the gate is rolled up.

The rolling gate 10 comprises a plurality of elongated, horizontally-disposed transparent slats 20, each pivotally interconnected by a plurality of elongated, horizontally-disposed metal rods or bars 22. The slats 20 are best shown in FIGS. 2 and 3, and each is molded in integral form of transparent material, preferably a plastic such as Plexiglass, with a straight, flat narrow body portion 24 terminating at each end in respective enlarged circular ribs or beads 26 and 28 which extend the full length of the slat 20.

Figure 4:
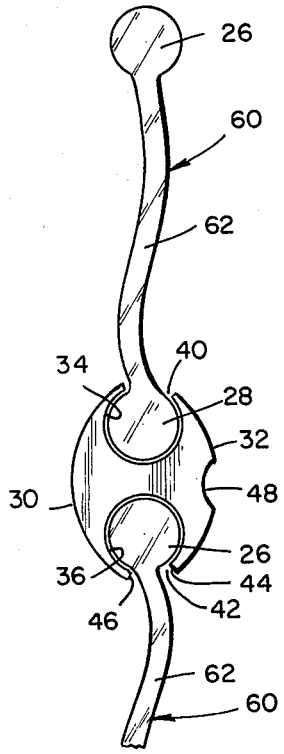
FIG. 4 is an end elevational view of a portion of the rolling gate similar to FIG. 3, but showing a modified form of transparent slat.
Figure 5:
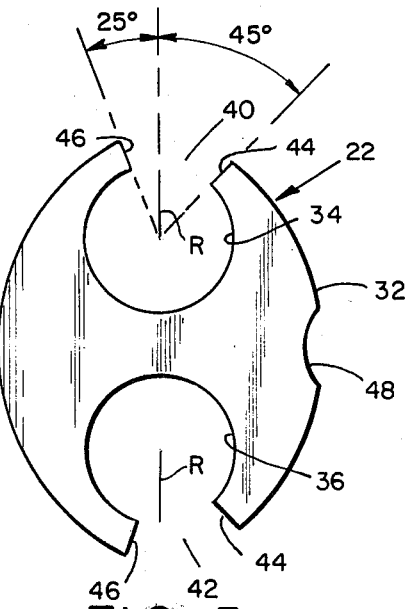
FIG. 5 is an enlarged end view of one of the horizontal metal bars of the gate.

Each of the metal rods 22 is preferably made of aluminum, and is formed with an elongated body of oval cross-section presenting convex front and rear walls 30 and 32. As shown in FIGS. 3–5, each rod 22 is provided with an elongated socket 34 of circular cross-section at its upper end and a similar elongated circular socket 36 at its lower end. The elongated sockets 34 and 36 extend the full length of the rod 22 in which they are formed, and each is sized to receive snugly a respective circular rib 26,28 of a transparent slat 20 for pivotal mounting of a pair of slats 20 upon each metal rod 22.

The slats 20 and rods 22 are of the same lengths and each extends the entire width of the building access opening 14. The slats and rods are, in fact somewhat longer than the width of said access opening. The terminal end portions of the interconnected slats and rods extend into U-shaped metal guide channels 38 secured within the side walls of the door frame 12 for free sliding movement therein when the rolling gate 10 is moved between its lowered and elevated positions. When the gate 10 is elevated to its open position, its side edge portions slide through the guide channels 38 and the transparent slats 20 pivot on the metal rods 22 and roll up with the latter into the hollow heading 18.

As shown in FIG. 5, each metal rod 22 is formed at its top end with an elongated slot 40 communicating with the socket 34, and at its bottom end with a similar elongated slot 42 communicating with the socket 36. The slots 40 and 42 are precisely dimensioned to limit the pivotal movement of the transparent slats 20 within the sockets 34 and 36 to the angular extents illustrated in FIG. 5. It will be seen that with respect to the circular socket 34, the rear edge 44 of slot 40 is so positioned that it forms an angle of 40° with the radius R of socket 34 which is aligned with the longitudinal axis of the metal rod 22. The front edge 46 of slot 40 is so positioned that it forms an angle of 25° with the radius R. Similarly, the edges 44 and 46 of the slot 42 form the same 40° and 25° angles with the radius R of circular socket 36.

The slot edges 44 and 46 thus serve as stops to limit pivotal movement of the slats 20 relative to the rods 22, in both directions, to the angular extents described above. FIG. 3 shows in phantom at 20′ the angular position of the uppermost slat 20, when the rolling gate 10 is rolled up to its elevated position. The slat is in engagement with the rear edge 44 of the upper slot 40 and has turned through an angle of approximately 40° from its original position in which it was axially aligned with the longitudinal axis of the attached rod 22. The position of the rear edges 44 of the slots 40 and 42 therefore provide a sufficient degree of flexibility to the rolling gate 10 to enable the latter to bend into rolled-up form when raised to its elevated position. The front edge 46 of the slots 40 and 42, which permits a smaller degree of forward pivotal movement of the slats 20 relative to the rods 22, provides a slight degree of flexibility of the gate 10 in a forward or outward direction when the gate is in its lowered position.

In a preferred commercial embodiment, the transparent slats 20 are made three inches in height, ⅛ inch in thickness, and five to twenty feet long, their length depending upon the width of the store front to be covered by the rolling gate. The metal rods 22 are approximately one and one-half inches in height and one inch wide. To cover over a standard store front of ten to twenty foot height, only thirty to forty of the transparent slats 20 are required, in contrast to the hundreds of short transparent panels required in a conventional grille-type gate of corresponding size.

For installation of the rolling gate 10, the required number of transparent slats and metal rods may be shipped in dissassembled condition to the store front, and assembly of the rolling gate performed at the installation site. For this purpose, the transparent slats 20 are pivotally mounted on the metal rods 22 simply by inserting the slats 20, one at a time, into the rods 22 from one end thereof; the slat ribs 26 and 28 entering the ends of the rod sockets 34 and 36 and sliding through said sockets until the slats are transversely aligned with the rods in the manner shown in FIG. 2. Each metal rod 22 is formed with an elongated notch 48 on its convex rear wall 32, which notch 48 serves as a means for identifying the rear surface of the rod during the assembly thereof, so that each rod is mounted in the proper direction with the socket edges 44 located inwardly toward the interior of the store front, and the socket edges 46 located outwardly or forwardly.

With the transparent plates 20 pivotally mounted on the metal rods 22 in the manner described above, the rolling gate 10 is fully assembled for use. The gate is slid from above into the guide channels 38 of the door frame 12, and the hollow heading 18 mounted in position with the top of the gate 10 rotatably mounted therein. When the gate 10 is raised to its elevated position, the edges of the gate slide upwardly through the guide channels 38 and the gate rolls up in the hollow heading 18, the slot edges 44 on the metal rods 22 permitting the gate to bend during this rolling-up movement.

Figure 6:
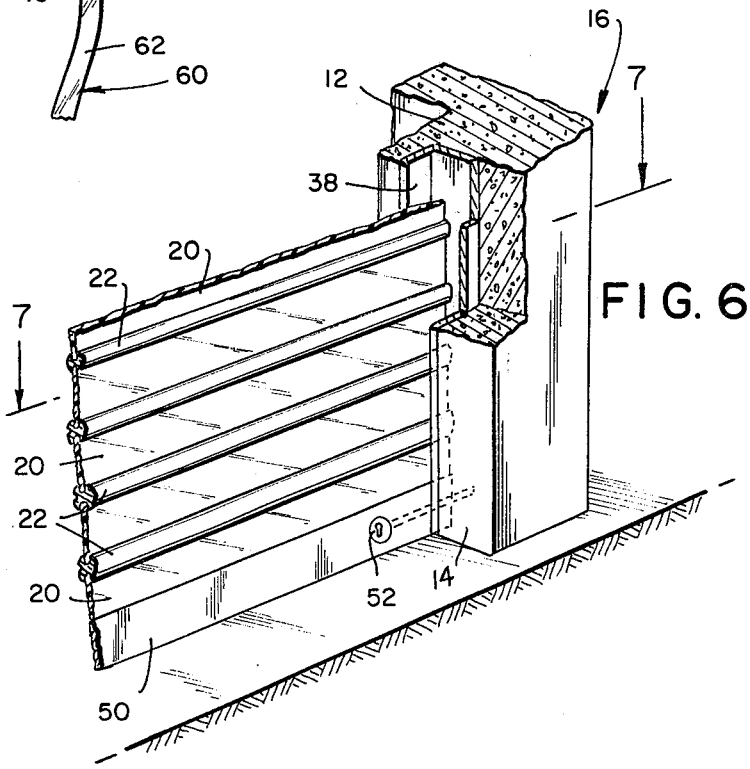
FIG. 6 is a partial perspective view of one end portion of the gate and the door frame channel in which it is slidably mounted, with portions of the door frame and channel broken away and shown in section.

The bottom end of the rolling gate 10 may terminate in a solid metal rectangular slat or bar 50 which may be provided with the usual handle (not shown) for ease in raising and lowering the gate. The bottom slat 50 may also be provided with a lock 52 (FIG. 6) for securing the gate in its lowered, closed position. Since the lock 52 is of conventional construction and forms no part of the present invention, its structure is not shown in detail herein. It is to be understood that any other type of suitable locking device, such as an ordinary padlock, may be employed with the gate 20.

FIG. 4 shows an alternate embodiment of transparent slat, designated by reference numeral 60. Instead of the straight flat body portion 24 of the transparent slat 20 shown in FIG. 3, the modified slat 60 has a body portion 62 having a sinuous configuration. In some installations, such configuration improves the aesthetic appearance of the gate, without detracting from the visibility therethrough. The slats 60 are in all other respects identical to the slats 20, terminating in the same elongated circular ribs or beads 26 and 28.

The interconnection of the transparent slats 20 or 60 with the metal rods 22, by means of the ribs 26 and 28 journalled in the rod sockets 34,36, provides a rolling gate which has a solid body from top to bottom and side to side, without any interruptions or spaces therein through which a tool or the like can be inserted.

Figure 8:
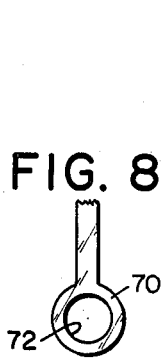
FIGS. 8 and 9 are end views of modified forms of ribs or beads on the transparent slats.
Figure 9:
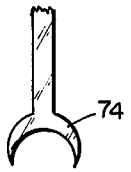
Figure 7:
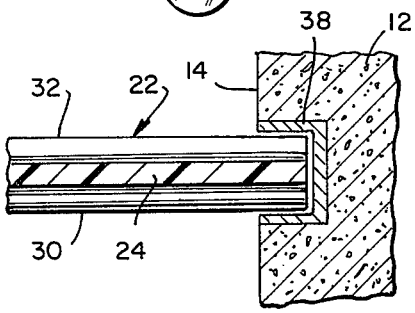
FIG. 7 is a section along line 7—7 of FIG. 6.

In the embodiment shown in FIGS. 1–6, the ribs or beads 26 and 28 at the ends of the transparent slats 20 are shown in solid form of circular cross-section. When the slats are molded by extrusion, it has been found that since the beads 26, 28 are enlarged relative to the slat body 24, the beads require a longer time for cooling and therefore tend to warp. To prevent such warping, the beads may be made in other shapes to present a mass closer to that of the slat body. FIG. 8 shows, for example, a slat bead or rib 70 which is circular and of the same diameter as bead 26, but which is provided with a central bore 72, so that it is hollow and tubular. FIG. 9 illustrates another embodiment of bead 74 which is of crescent shape. The bead may be made in a variety of other shapes, such as semi-circular, star shaped, bone-shaped or the like, provided that the effective radius of the bead is sufficient to enable it to provide freely within the respective socket 34 or 36 of the metal rod 22.

While preferred embodiments of the invention have been shown and described herein, it is evident that numerous omissions, changes and additions may be made in such embodiments without departing from the spirit and scope of the invention.

What I claim is:

1. A rolling gate adapted to provide a transparent displaceable security closure for a building access opening defining a store front, said gate comprising:

a plurality of elongated transparent slats disposed horizontally in vertically-spaced relationship, each slat having a narrow, rectangular body portion and being sized to extend across the entire width of said access opening, a plurality of elongated metal rods interconnecting said slats in their spaced relationship, with each rod being sized to extend across the entire width of said access opening, each of said elongated metal rods being elliptical in cross section and having convex front and rear walls, each rod having a height appreciably less than the height of the body portion of each slat, and a width appreciably greater than the thickness of the body portion of each slat, and coupling means formed integrally on each of said slats and rods for pivotally connecting each transparent slat along its entire upper and lower edges between a pair of adjacent rods to form the assembled gate, said coupling means comprising an enlarged bead formed integrally along the full length of each longitudinal edge of the narrow body portion of each transparent slat, and a pair of elongated sockets of circular cross-section formed integrally in the upper and lower portions of each metal rod and extending the full length of said rod, each of said sockets being sized to receive the enlarged bead of an adjacent slat for turning movement therein, whereby said interconnected and articulated slats and rods provide a rolling security gate for said store front, which, in lowered position, has a completely solid body without interruptions or gaps, which provides visibility of said store front and passage of light therethrough.

2. A rolling gate according to claim 1 in which said enlarged bead comprises a rib of circular cross section formed integrally along a longitudinal edge of each of said slats.

3. A rolling gate according to claim 2 in which said rib is hollow and tubular.

4. A rolling gate according to claim 2 in which each of said slats is formed from transparent plastic with a thin central body portion and ribs of a diameter greater than the thickness of said body portion extending the entire lengths of the upper and lower edges of said body portion.

5. A rolling gate according to claim 4 in which said slat body portion has flat front and rear surfaces.

6. A rolling gate according to claim 4 in which said body portion of each slat has a sinuous configuration.

7. A rolling gate according to claim 1 in which each of said metal rods has a first socket formed adjacent the upper and thereof, a second socket formed adjacent the lower end thereof, a first slot extending through said upper end and communicating with said first socket, and a second slot extending through said lower end and communicating with said second socket, the central body portions of each of the transparent slats mounted on said metal rods extending through the respective upper and lower slots of said rods.

8. A rolling gate according to claim 7 in which each of said slots has a width substantially greater than the thickness of said slat central body portions, each slot having front and rear edge surfaces positioned to engage the central body portion of the slat extending therethrough and to limit turning movement of the slat rib mounted in the socket communicating with said slot.

9. A rolling gate according to claim 8 in which each of said slots has a front edge disposed at an angle sufficient to permit said slats to be pivoted relative to said rods by an angle large enough to enable said gate to be rolled up, and a rear edge disposed at an appreciably smaller angle to limit forward flexing of said gate.

10. A rolling gate according to claim 1 in which said metal rods are of such length that their opposite ends extend into guide channels located at each side of said building access opening.

* * * * *